US006582036B2

(12) United States Patent
Alexander et al.

(10) Patent No.: US 6,582,036 B2
(45) Date of Patent: Jun. 24, 2003

(54) DOOR RETAINING DEVICE

(75) Inventors: Allen Eugene Alexander, Fresno, CA (US); Larry Edward Hieb, Fresno, CA (US)

(73) Assignee: The Vendo Company, Fresno, CA (US)

( * ) Notice: Subject to any disclaimer, the term of this patent is extended or adjusted under 35 U.S.C. 154(b) by 0 days.

(21) Appl. No.: 09/911,282

(22) Filed: Jul. 23, 2001

(65) Prior Publication Data

US 2003/0015948 A1 Jan. 23, 2003

(51) Int. Cl.[7] ..... A47B 49/00
(52) U.S. Cl. ..... 312/326; 292/102; 292/203
(58) Field of Search ..... 312/215, 329, 312/326–328, 293.1–293.3, 138.1, 139, 139.1–139.2, 109, 107.5, 21–24; 292/136, 101–102, 238, 202, 203; 49/394; 16/229–232, 262, 324, 326

(56) References Cited

U.S. PATENT DOCUMENTS

| | | | | | |
|---|---|---|---|---|---|
| 836,095 | A | * | 11/1906 | Cook | 292/101 |
| 1,473,869 | A | * | 11/1923 | Pinten | 292/105 |
| 1,570,195 | A | * | 1/1926 | Ausdal | 292/136 |
| 1,827,143 | A | * | 10/1931 | Doyle | 16/83 |
| 2,194,408 | A | * | 3/1940 | Sluss | 292/136 |
| 3,219,973 | A | * | 11/1965 | Lenz | 292/202 |
| 3,525,544 | A | * | 8/1970 | Jacobs | 16/232 |
| 4,135,375 | A | * | 1/1979 | Voegeli | 312/306 |
| 4,161,333 | A | | 7/1979 | Guttman | 292/288 |
| 4,503,583 | A | * | 3/1985 | Frohbieter | 16/232 |
| 5,143,430 | A | * | 9/1992 | Craven et al. | 312/291 |
| 5,724,705 | A | | 3/1998 | Hauser | 16/388 |
| 5,726,427 | A | * | 3/1998 | Hwang | 126/194 |
| 5,927,766 | A | * | 7/1999 | Rosen | 292/101 |
| 6,025,581 | A | * | 2/2000 | Kang et al. | 126/194 |
| 6,043,473 | A | * | 3/2000 | Isogai et al. | 126/197 |
| 6,061,966 | A | * | 5/2000 | Nelson et al. | 220/831 |
| 6,079,081 | A | * | 6/2000 | Padiak et al. | 16/321 |
| 6,085,385 | A | * | 7/2000 | Joo | 16/262 |
| 6,371,581 | B1 | * | 4/2002 | Ring et al. | 312/138.1 |
| 6,394,539 | B1 | * | 5/2002 | Park | 292/DIG. 5 |
| 2002/0093203 | A1 | * | 7/2002 | Moretz | 292/113 |

* cited by examiner

*Primary Examiner*—Daniel P. Stodola
*Assistant Examiner*—Jennifer E. Novosad
(74) *Attorney, Agent, or Firm*—Baker Botts L.L.P.

(57) ABSTRACT

A door retaining device having particular application for preventing unauthorized removal of vending machine doors from vending machine housings. The door retaining device is fixedly secured at a first end to the vending machine door, and cooperates with the vending machine housing at a second end to permit rotation of the door relative to the housing about at least one hinge pin, but to substantially prevent movement of the door relative to the housing other than rotation about the at least one hinge pin. The door retaining device has a hook portion at the second end that extends into the housing through an aperture in the housing. The hook portion engages the housing to prevent movement of the door relative to the housing other than rotation about the at least one hinge pin.

8 Claims, 3 Drawing Sheets

DOOR RETAINING DEVICE

TECHNICAL FIELD

This invention relates in general to the field of security systems for doors, and more particularly, to a system and method for securing a hinged door in a manner that helps prevent removal of the door in the event that the door hinge pin is cut or damaged. The system and method is particularly useful to prevent vandalism and theft in vending machines and the like.

BACKGROUND

Vending machines are widely used to dispense beverages, food, and other perishable and non-perishable goods. These vending machines provide valuable services in that they enable goods to be sold, and persons to obtain such goods, without attending personnel. As a consequence, vending machines are most useful, and are typically found in areas where there is little supervision, particularly by those who own the machines. They often are found outside, or in other public places that may be deserted during much of the day and/or night. Thus, vending machines are frequently the target of vandals and thieves attempting to gain access to either the goods stored within the vending machine or the coin and/or bill storage device or the like that retains money from goods already sold.

Thieves or vandals commonly gain access to the contents of vending machines by cutting or otherwise damaging the hinge pin that couples the vending machine door to the vending machine. Once the hinge pin is cut or sufficiently damaged, the door can be removed from the front of the vending machine, and the contents of the machine accessed.

There is a need in the art for a vending machine having a security feature that prevents a thief or vandal that has cut the door hinge pin from subsequently removing the door.

SUMMARY

Accordingly, a vending machine is provided having a vending machine housing, a vending machine door, a pivoting device pivotably coupling the vending machine door to the vending machine housing, and a door retaining device fixedly secured at a first end to the vending machine door, and in cooperation with the vending machine housing at a second end so as to permit rotation of the vending machine door relative to the vending machine housing about the pivoting device between a closed and an open position, but so as to be capable of engaging the vending machine housing to substantially prevent removal of the vending machine door from the vending machine housing if the pivoting device is damaged when the vending machine door is in the closed position. According to one embodiment, the vending machine housing has an aperture therein, and the second end of the door retaining device has a hook portion that extends within the vending machine housing through the aperture.

According to yet another embodiment, when in the closed position, the hook portion of the door retaining device is positioned within an interior of the vending machine housing.

According to yet another embodiment, the pivoting device is at least one hinge pin, and the vending machine housing includes a hinge box surrounding at least a portion of the at least one hinge pin, and having the vending machine housing aperture therein. In yet another embodiment, the vending machine door pivots relative to the vending machine housing, and the hook portion of the door retaining device pivots relative to the hinge box unobstructed by the vending machine housing. In yet another embodiment, the first end of the door retaining device further includes a projecting portion that extends to within the vending machine door through a vending machine door aperture.

According to yet another embodiment, the first end of the door retaining device is fixedly secured to the vending machine door by a screw, and in yet another embodiment, a head of the screw is positioned within the vending machine door.

In yet another embodiment, the door retaining device further includes an intermediate portion between the hook portion and the projecting portion, the intermediate portion includes a first portion extending substantially perpendicularly from a first end of the projecting portion and positioned substantially adjacent to the vending machine door, a second portion extending substantially perpendicularly from a first end of the first portion and in a direction opposite that of the projecting portion, and a third portion extending substantially perpendicularly from a first end of the second portion and in a direction substantially opposite that of the first portion. In yet another embodiment, the first portion of the intermediate portion of the door retaining device has an aperture therein, and the screw extends through the aperture in the first portion. In yet another embodiment, the third portion of the intermediate portion has a length such that when the vending machine door is pivoted about the at least one hinge pin between the closed and open positions, the second portion of the door retaining device does not contact the hinge box.

A storage unit is also provided including a housing, a door pivotably coupled to the housing by at least one hinge pin, and pivotable about the at least one hinge pin between an open position and a closed position, and a door retaining device fixedly secured at a first end to the door, and in cooperation with the housing at second end so as to permit rotation of the door relative to the housing between the open position and the closed position, but so as to be capable of engaging the housing to substantially prevent removal of the door from the housing if the at least one hinge pin is damaged when the door is in the closed position.

According to one embodiment, the door retaining device has a first end and a second end having a hook portion of the second end, and the housing has an aperture therein, and the hook portion extends through the aperture. In yet another embodiment, a first edge of the hook portion is positioned within an interior of the housing when the door is in the closed position.

In yet another embodiment, the door retaining device further includes a projecting portion at the first end and the door further includes an aperture therein, and the projecting portion extends through the aperture in the door. In yet another embodiment, when the door pivots relative to the housing between the open and closed positions, the hook position of the door retaining device pivots relative to the housing unobstructed by the housing.

In yet another embodiment, the first end of the door retaining device is fixedly secured to the door by a screw, and in yet another embodiment, a head of the screw is positioned within the door.

According to yet another embodiment, the door retaining device further includes an intermediate portion between the hook portion and the projecting portion, and the intermediate portion includes a first portion extending substantially perpendicularly from a first end of the projecting portion and positioned substantially adjacent to the door, a second portion extending substantially perpendicularly from a first end of the first portion and in a direction opposite that of the projecting portion, and a third portion extending substantially perpendicularly from a first end of the second portion and in a direction substantially opposite that of the first portion.

A door retaining device is also provided for preventing unauthorized removal of a vending machine door from a vending machine housing, wherein the vending machine door is pivotably coupled to the vending machine housing by a pivoting device, and pivotable relative to the vending machine housing between an open position and a closed position. The door retaining device includes a first end capable of being fixedly secured to the vending machine door, a second end having a hook portion for extending through an aperture in the vending machine housing. The hook portion is capable of engaging the vending machine housing to substantially prevent removal of the vending machine door from the vending machine housing if the pivoting device is damaged when the vending machine door is in the closed position In yet another embodiment, the first end of the door retaining device further includes a projecting portion for projecting into an aperture in the vending machine door. In yet another embodiment, the first end of the door retaining device further includes an aperture for receiving a screw for fixedly securing the door retaining device to the vending machine door.

In yet another embodiment, the vending machine housing includes a hinge box portion surrounding at least a portion of the pivoting device, and has the vending machine housing aperture therein.

According to yet another embodiment, the door retaining device further includes an intermediate portion between the hook portion and the projecting portion. The intermediate portion has a first portion extending substantially perpendicularly from a first end of the projecting portion, a second portion extending substantially perpendicularly from a first end of the first portion and in a direction opposite that of the projecting portion, and a third portion extending substantially perpendicularly from a first end of the second portion and in a direction opposite that of the first portion.

BRIEF DESCRIPTION OF THE DRAWINGS

A more complete understanding of the present invention and advantages thereof may be acquired by referring to the following description taken in conjunction with the accompanying drawings, in which like reference numbers indicate like features, and wherein.

DETAILED DESCRIPTION

Preferred embodiments of the present invention are illustrated in the Figures, like numeral being used to refer to like and corresponding parts of the various drawings.

Figure 1:
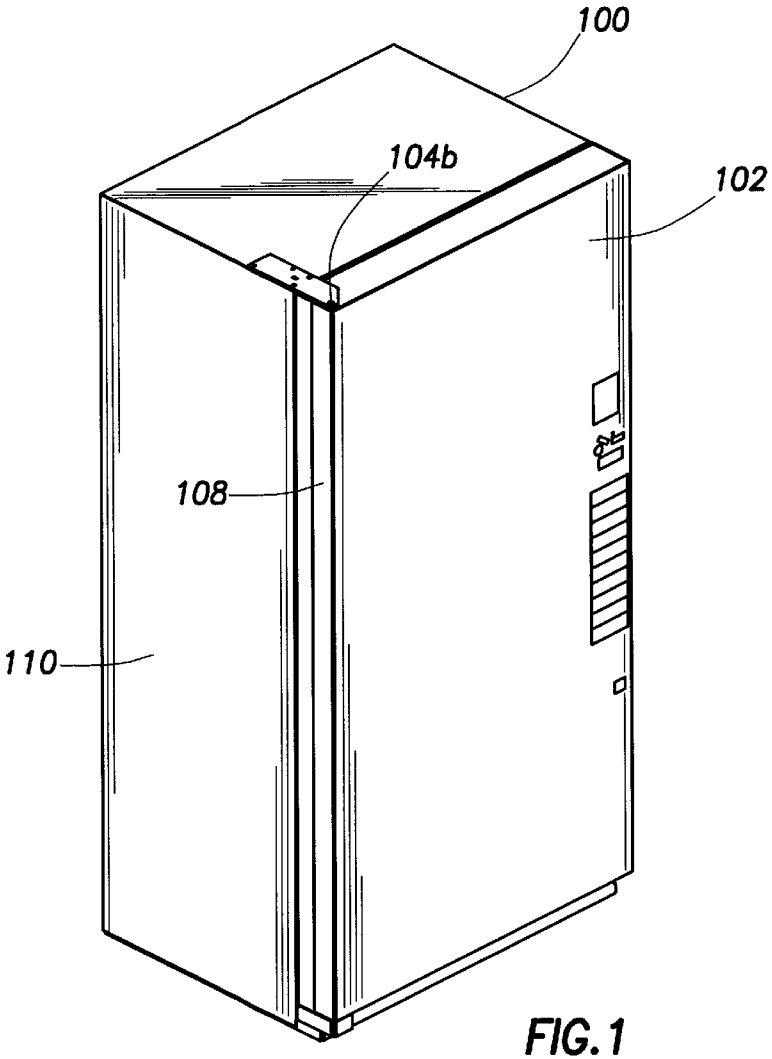
FIG. 1 illustrates generally a typical vending machine.

Referring now to FIG. 1, a typical vending machine includes a housing 100, and a door 102. The door is pivotally coupled at a first side 108 to a first side 110 of the housing so that the door may swing outwardly around one or more hinge pins 104*a*, 104*b* between a closed position wherein the interior of the vending machine (and its contents) is not exposed, and an open position wherein the interior of the vending machine is exposed.

Figure 2:
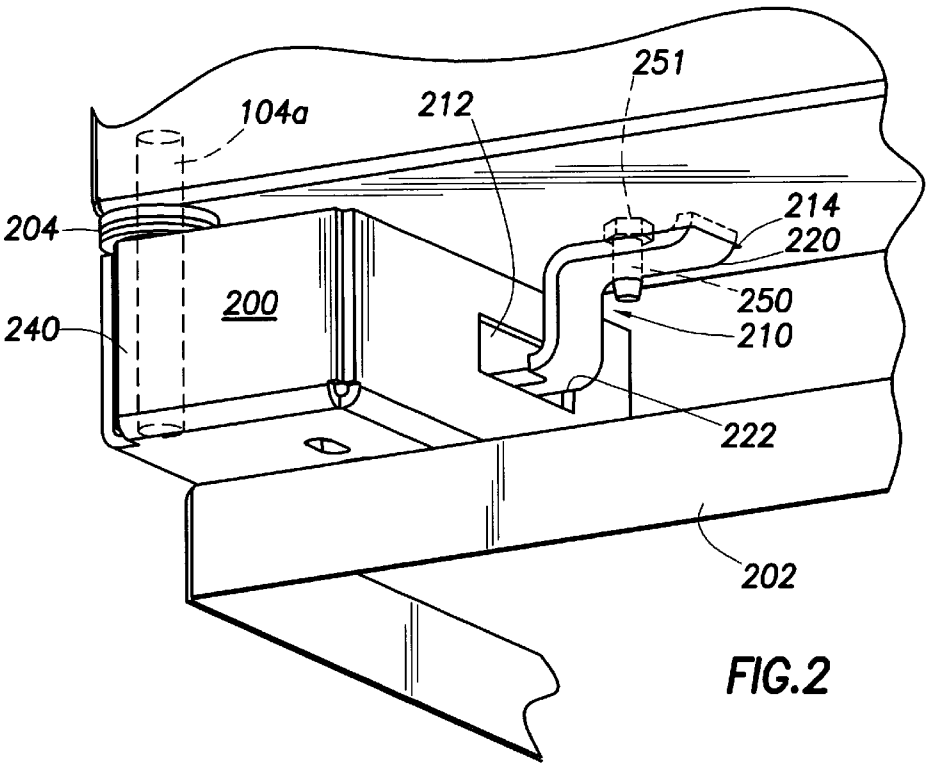
FIG. 2 illustrates a door retaining device according to the present disclosure installed in a vending machine when the vending machine door is closed.

According to one embodiment, as shown in FIG. 2, the housing 100 includes a hinge box 200 that serves to protect hinge pin 104*a* from damage. The hinge pin 104*a* extends into, and is rotatably secured within hinge box 200. One or more washers 204 or the like may also be used to protect any exposed portion of the hinge pin.

A door retaining device 210 provides additional protection against removal of the door 102 if the hinge pins 104*a*, 104*b* are damaged or cut. The door retaining device includes a first end 220 that is fixedly secured to the door member by a screw 250 or the like, and a second end 222 that extends into an aperture in the hinge box 200. As will be described more fully below, this door retaining device secures the door to the hinge box, and therefore to the housing, so as to prevent movement of the door relative the housing when the door is in the closed position, even when the hinge pin has been cut or severely damaged. The door retaining device will, however, allow the door to pivot relative to the housing about the hinge pin to enable an authorized user to open the door in the appropriate manner.

Figure 3:
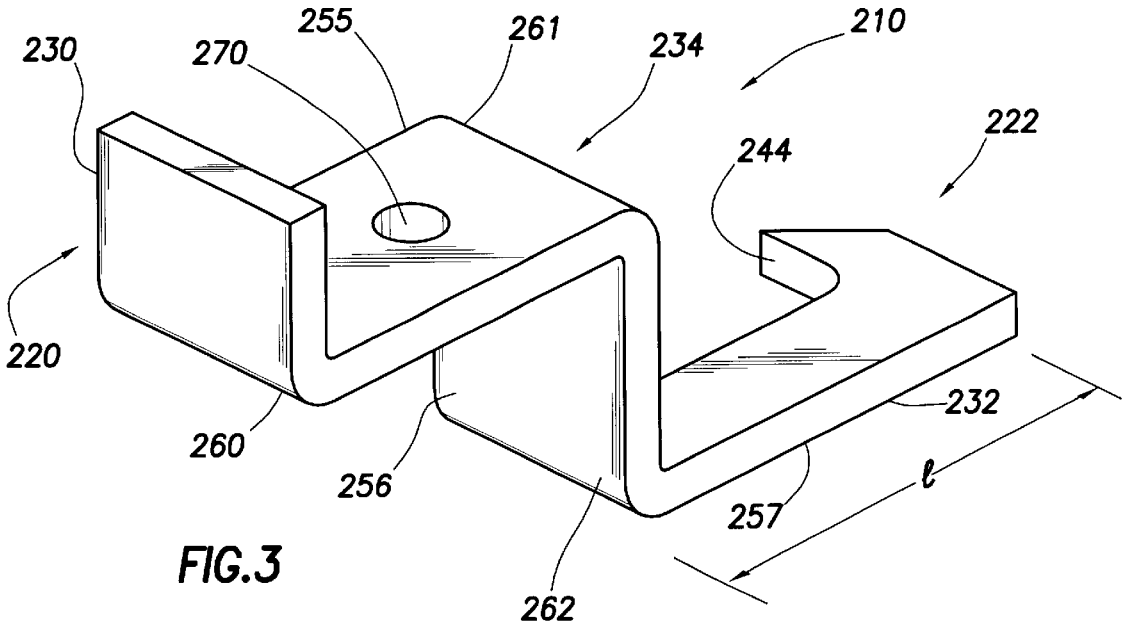
FIG. 3 illustrates a door retaining device according to the present disclosure.
Figure 4A:
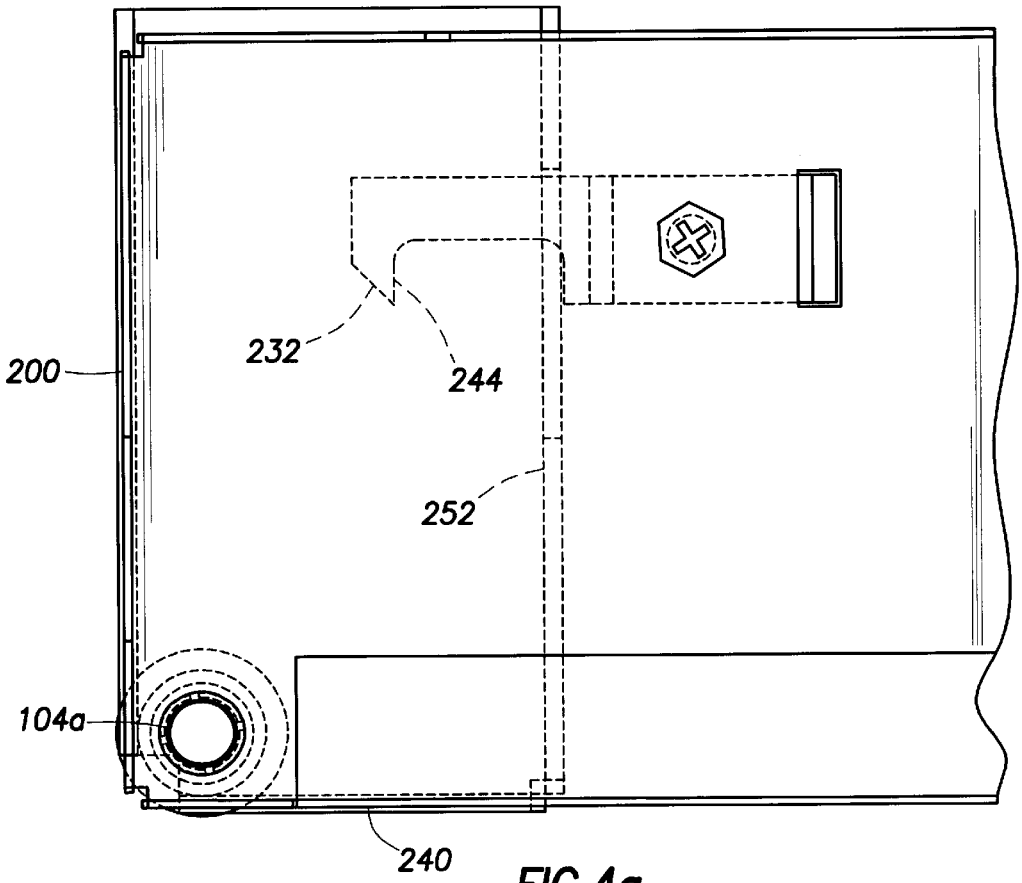
FIG. 4*a* is a cross-sectional top view illustrating a door retaining device according to the present disclosure relative to the hinge box when the vending machine door is closed.

As shown in greater detail in FIG. 3, according to one embodiment the door retaining device includes a first end 220 having a projecting portion 230 and a second end 222 having a hook portion 232. When the door retaining device is installed in a vending machine, the projecting portion 230 extends into the door 102 through a door aperture 214, which is preferably of a size and shape to accept the projecting element, but to substantially prevent the door retaining device from moving laterally relative to the door. Further, the hook portion 232 of the second end 222 of the door retaining device extends into the hinge box through an aperture 212 therein. As illustrated further in FIG. 4*a*, the door retaining device is configured so that when the door 102 is in the closed position, the hook portion 232 extends toward the outer side 240 of the hinge box, which is toward the front of the vending machine. When in place, the hook portion projects through the aperture 212 and into the interior of the hinge box. Although, the first side edge 244 need not physically contact the interior surface 252 of the hinge box when the door is in the closed position, it must be positioned so as to engage this interior surface to prevent the door from being removed from the housing in the event that the hinge pins are no longer functional to secure the door to the housing, as is the case if cut or severely damaged.

Figure 4B:
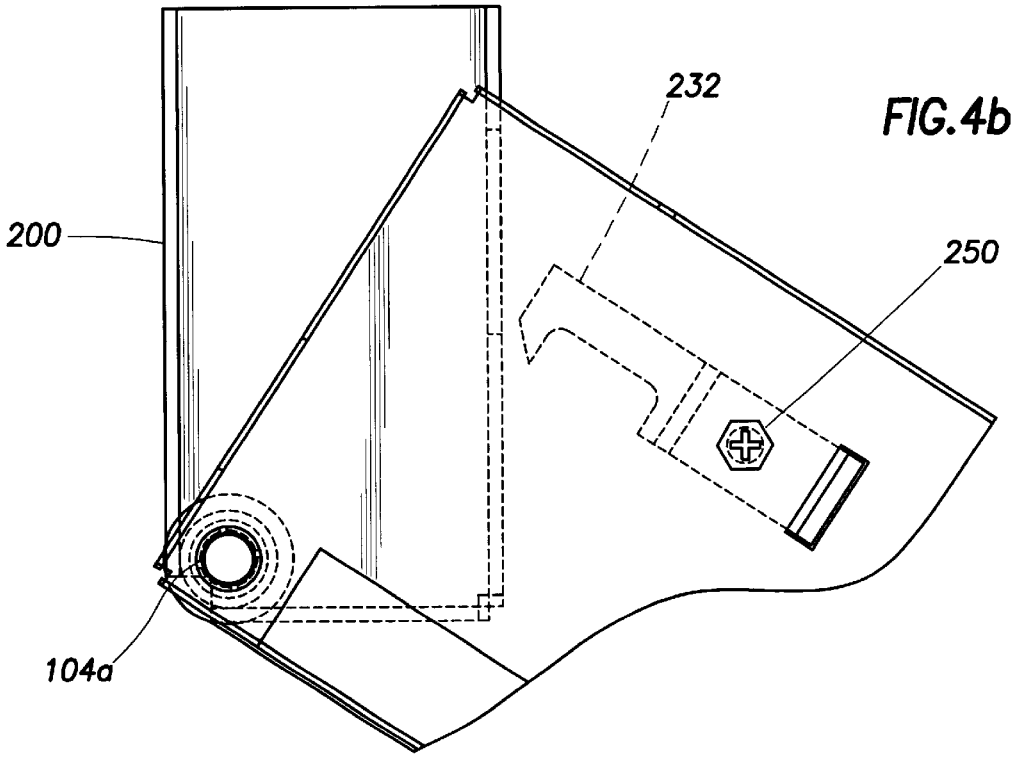
FIG. 4*b* is a cross-sectional top view illustrating a door retaining device according to the present disclosure relative to a hinge box when the vending machine door is open.
Figure 5:
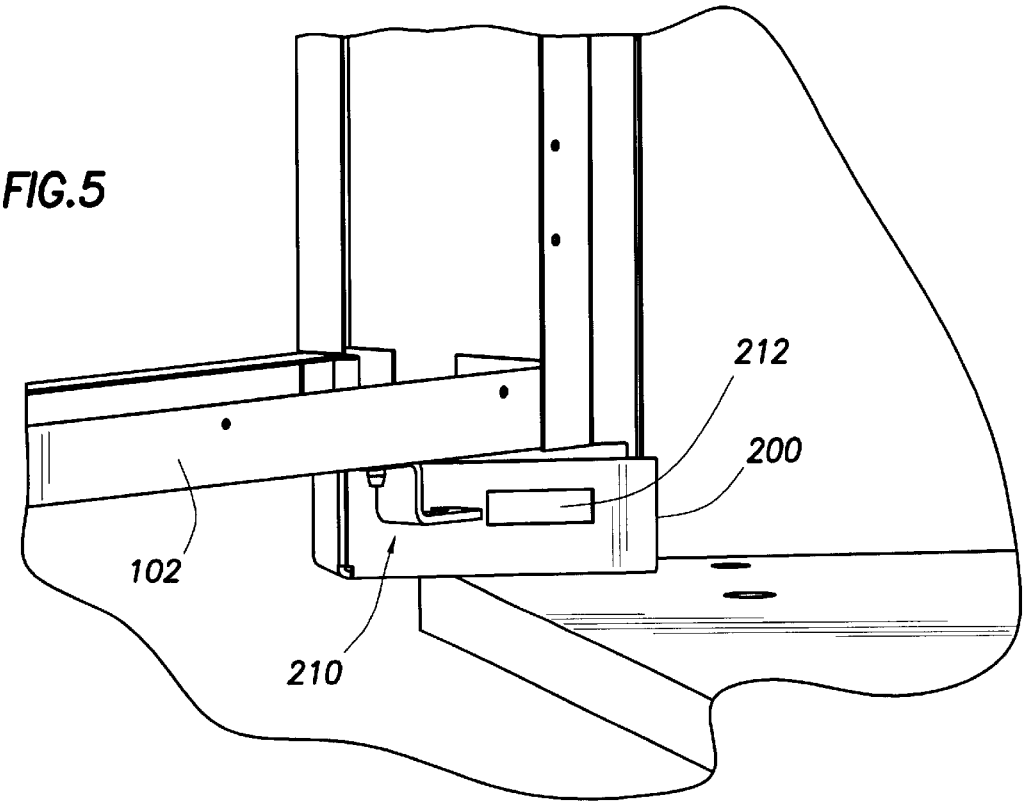
FIG. 5 illustrates a door retaining device according to the present disclosure installed in a vending machine when the vending machine door is closed.

As described, the hook portion 232 extends through the hinge box aperture and into the interior of the hinge box when the door is in the closed position. The door retaining device, however, moves relative to the hinge box as the door opens, as it is fixedly secured to the door but not the hinge box. The hinge box aperture is of such a size so as not to obstruct this movement. FIG. 4*b* illustrates the position of the hook portion of the door retaining device relative to the hinge box according to one embodiment when the door is in the open position. FIG. 5 further illustrates a vending machine having a door retaining device when the door is in the open position.

Referring again to FIG. 3, according to one embodiment, the door retaining device includes an intermediate portion 234 between the projecting portion 230 and the hook portion 232. The intermediate portion includes a first portion 255, a second portion 256, and a third portion 257. The first portion 255 extends substantially perpendicularly from a first end 260 of the projecting portion. When installed in a vending machine this first portion is positioned substantially adjacent to the door. Preferably, the first portion includes an aperture 270 therein for receiving screw 250 or the like for fixedly securing the door retaining device to the door. For added security, the head 251 of the screw may be positioned on the inside of the door and extend downwardly through the door and through the door retaining hook aperture.

The second portion 256 extends substantially perpendicularly from a first end 261 of the first portion, and in a direction substantially opposite to that of the projecting portion. Extending substantially perpendicularly first from a first end 262 of said second portion 256 to said hook portion to said hook portion, and in a substantially the same plane as said hook portion is the third portion 257. The third portion is of a length l that provides sufficient clearance so that no portion of the door retaining devices interferes with the hinge box as the door pivots between the open and closed positions. Interference may occur when attempting to pivot the door beyond the established open position.

Thus, when the vending machine door 102 is closed, in the event that the hinge pins are severely damaged or cut, the hook portion engages the hinge box to prevent removal of the door from the housing. As indicated, however, the door retaining device prevents unauthorized removal of the door, but still allows the door to swing about the hinge pin between the open and closed positions.

Although the present invention has been described in detail, it should be understood that various changes, substitutions and alterations can be made hereto without departing from the spirit and scope of the invention as defined by the appended claims. For example, the configuration of the second end of the door retaining device that extends into the interior of the hinge box may vary, so long as the configuration is such that when in the closed position, it will prevent the door from being removed from the housing in the event that the hinge pins are no longer functional. Further, the door retaining device described herein may be used in units other than vending machines, such as any storage unit having a door pivotably coupled thereto.

What is claimed is:

1. A vending machine comprising:

a vending machine housing;

a vending machine door;

a pivoting device coupling said vending machine door to said vending machine housing; and a door retaining device fixedly secured at a first end to said vending machine door, and in cooperation with said vending machine housing at a second end so as to permit rotation of said vending machine door relative to said vending machine housing about said pivoting device between a closed position and an open position, and so as to be capable of engaging said vending machine housing to substantially prevent removal of said vending machine door from said vending machine housing when said pivoting device is damaged when said vending machine door is in said closed position;

wherein said vending machine housing has an aperture therein, and wherein said second end of said door retaining device has a hook portion, said hook portion extending to within said vending machine housing through said aperture;

wherein when in said closed position, said hook portion of said door retaining device is positioned within an interior of said vending machine housing;

wherein said pivoting device is at least one hinge pin, and wherein said vending machine housing includes a hinge box surrounding at least a portion of said at least one hinge pin, said hinge box having said vending machine housing aperture therein.

2. The vending machine according to claim 1, wherein when said vending machine door pivots relative to said vending machine housing, said hook portion of said door retaining device pivots relative to said hinge box unobstructed by said vending machine housing.

3. The vending machine according to claim 2, wherein said first end of said door retaining device further comprises a projecting portion, and wherein said projecting portion extends to within said vending machine door through a vending machine door aperture.

4. The vending machine according to claim 3, wherein said first end of said door retaining device is fixedly secured to said vending machine door by a screw.

5. The vending machine according to claim 4, wherein a head of said screw is positioned within said vending machine door.

6. The vending machine according to claim 5, wherein said door retaining device further comprises an intermediate portion between said hook portion and said projecting portion, and wherein said intermediate portion includes a first portion extending substantially perpendicularly from a first end of said projecting portion and positioned substantially adjacent to said vending machine door, a second portion extending substantially perpendicularly from a first end of said first portion and in a direction opposite that of said projecting portion, and a third portion extending substantially perpendicularly from a first end of said second portion and in a direction substantially opposite that of said first portion.

7. The vending machine according to claim 6, wherein said first portion of said intermediate portion of said door retaining device has an aperture therein, and wherein said screw extends through said aperture in said first portion.

8. The vending machine according to claim 7, wherein said third portion of said intermediate portion has a length such that when said vending machine door is pivoted about said at least one hinge pin between said closed and open positions, said second portion of said door retaining device does not contact said hinge box.

* * * * *